United States Patent [19]

Goda

[11] 4,315,689

[45] Feb. 16, 1982

[54] SHOT SIMULATOR USING LASER LIGHT FOR SIMULATING GUIDED MISSILES

[76] Inventor: Wilfried Goda, Tinsdaler Kirchweg 229, 2000 Hamburg 56, Fed. Rep. of Germany

[21] Appl. No.: 87,735

[22] Filed: Oct. 24, 1979

[30] Foreign Application Priority Data

Oct. 27, 1978 [DE] Fed. Rep. of Germany ..... 2846962

[51] Int. Cl.[3] ..... G01B 11/26; F41F 27/00; F41G 3/26

[52] U.S. Cl. ..... 356/141; 89/41 L; 273/310; 356/5; 434/22

[58] Field of Search ..... 356/5, 141, 152; 89/41 L; 35/25; 273/310

[56] References Cited

U.S. PATENT DOCUMENTS

| | | | |
|---|---|---|---|
| 3,609,883 | 10/1971 | Erhard | 35/25 |
| 3,845,276 | 10/1974 | Kenoy et al. | 89/41 L |
| 3,927,480 | 12/1975 | Robertsson | 35/25 |
| 3,955,292 | 5/1976 | Robertsson | 35/25 |
| 4,063,368 | 12/1977 | McFarland et al. | 35/25 |

FOREIGN PATENT DOCUMENTS

| | | | |
|---|---|---|---|
| 2149701 | 3/1976 | Fed. Rep. of Germany | 356/5 |

*Primary Examiner*—S. C. Buczinski
*Attorney, Agent, or Firm*—Arnold, White and Durkee

[57] ABSTRACT

A shot simulator using laser light is disclosed for simulating guided missiles. A laser transmitter coupled to a target tracking sight emits differently coded laser signals having different angular deviations from the line of sight repeatedly during at least a substantial portion of the time of flight of the simulated missile. A receiver for laser light reflected from the target is coupled to decoding and analyzing means for calculating the momentary angular deviation of the sight from the target and evaluating these deviations over a substantial portion of said time of flight. Hit indicating means are controlled responsive to the result of said evaluation. The device further comprises means for comparing the angular deviations with stored data representing maximum admissible deviations and/or with an apparent typical target size calculated from a continuously measured actual target distance, means for continuously displaying the relative positions of the target and the sight tracking point, means for differently weighting downward, upward and lateral deviations and means for time averaging the evaluation results over a substantial portion of said time of flight.

7 Claims, 2 Drawing Figures

SHOT SIMULATOR USING LASER LIGHT FOR SIMULATING GUIDED MISSILES

BACKGROUND OF THE INVENTION

The invention pertains to a shot simulator using laser light and particularly to a simulator for simulating guided missiles which are controlled towards a target by continuously tracking the target with a sight of a weapon during the travelling time of the missile.

It is wellknown in the art to use laser radiation transmitters coupled to a weapon for simulating actual shooting and thereby practising the shooting operation of the weapon and the skill of the aimsman without the need of actually firing ammunition from the weapon. When actuating the trigger of the weapon the laser transmitter will emit a narrow beam of laser radiation substantially along the line of sight, preferably a bundle or succession of differently coded radiation beams having different small angular deviations from the line of sight. By receiving the laser radiation at the target position or the radiation reflected from the target and analysing the code thereof the amount and direction of the angular deviation of the sight from the target at the moment of firing the weapon may be calculated and a hit indicating device may be controlled depending on whether or not this angular deviation corresponds to a correct aiming of the weapon. The known shot simulators of this kind, however, are only suitable for simulating the shooting with projectiles or unguided ballistic missiles where the firing accuracy depends only on the correct target tracking and aiming of the weapon at the moment of firing the weapon.

On the other hand there have been known weapons using guided missiles which after firing are controlled towards a target by keeping the line of sight of the weapon aimed towards the normally moving target during the total travelling time of the missile. An example for weapons of this type are the so-called beam rider missiles which are adapted to automatically follow a guiding laser beam emitted by a laser transmitter coupled to the sight of the weapon. With weapons of this type the accuracy of the shot does not entirely depend on the correct aiming of the weapon at the moment of firing, but mainly on the accuracy with which the tracking point of the sight is kept coincident with the target during the travelling time of the missile. Short momentary deviations of the line of sight from the target are of course unavoidable. These deviations are tolerable if they are small and short enough, but the more frequent these deviations occur, the greater they are, the longer they last and the closer they are to the end of the travelling time, the greater will be the likelihood that the missile will not reach the target.

A shot simulator for simulating such guided missiles has been known from German Pat. No. 2 149 701. It uses a laser transmitter which emits a laser beam continuously over a period of time corresponding to the travelling time of the simulated missile, and it measures those time intervals during which the target actually receives the laser radiation and compares the sum of these intervals with the aforementioned period of time. A hit or miss indicating device is controlled depending on whether the laser radiation has reached the target over a sufficient portion of time within the simulated missile travelling time. The hit indication is further controlled in a statistical manner by using a random generator in order to similate the fact that the tracking deviations occurring during the tracking time will have different influence on the hit accuracy depending on their magnitude, direction and the time at which they occur.

Although this prior art shot simulator until now has been the best approach to a realistic simulation of sight guided missiles, it does nevertheless not provide a completely realistic simulation of such shooting. For example it only enables to distinguish between a hit and a miss-hit, but it does not enable to determine quantitatively how close to a hit a miss-hit has been. Moreover with the prior art device it is not possible to take account of the fact that certain types of deviations, for example those downwardly directed, have a greater likelihood of causing a miss-hit than others, and also the quantitative relation between the magnitude and duration of tracking deviations and the inertia of the particular missile which is to be simulated cannot be taken account of.

OBJECTS OF THE INVENTION

It is therefore an object of the invention to provide a shot simulator for simulating sight guided missiles which enables as realistically as possible to take account of the influence of the various tracking faults which will occur in practice.

It is another object of the invention to provide a shot simulator for guided missiles which will not only give a correct indication of a hit or miss but will also give to the aimsman or to a supervisor a quantitative indication of the accuracy of the shot.

It is a further object of the invention to provide a shot simulator for guided missiles which may be easily adapted or programmed to simulate missiles of different type and will take account of the fact that missiles having different velocity and inertia will respond differently to tracking faults and tracking corrections.

These and other objects of the invention will become more apparent from the following description of a preferred embodiment of the invention.

SUMMARY OF THE INVENTION

The shot simulator according to the invention uses a laser transmitter coupled to a target tracking sight for emitting differently coded laser signals having different angular deviations from the line of sight repeatedly during a period of time corresponding to the time of flight of the simulated missile or at least to a substantial portion thereof. A receiver for receiving laser light reflected from the target is coupled to decoding and analysing means for calculating the magnitude and direction of the momentary angular deviation of the line of sight from the target and for evaluating these deviations over a substantial portion of said period of time. Hit indicating means are controlled responsive to the result of said evaluation.

The analysing and evaluating means may be easily programmed so as to differently and realistically determine the influence of different types of tracking faults. For example the momentary angular deviation may be compared with stored data representing maximum admissible deviation limits, and these limits may be different for downward deviations, which would cause ground contact of an actual missile, than for upward or lateral deviations. The aforementioned evaluation may include the continuous forming of a time average of said deviation over an interval of time which may be selected so as to take account of the inertia with which the missile will respond to tracking controls. The device may further include means for continuously measuring the actual target distance and for calculating therefrom not only the missile travelling time but also an apparent typical target size with which the momentary tracking deviations may be compared, and means may be provided to display the sight tracking point or the missile impact point in its relative position to the apparent target size.

DESCRIPTION OF THE PREFERRED EMBODIMENT

Figure 1:
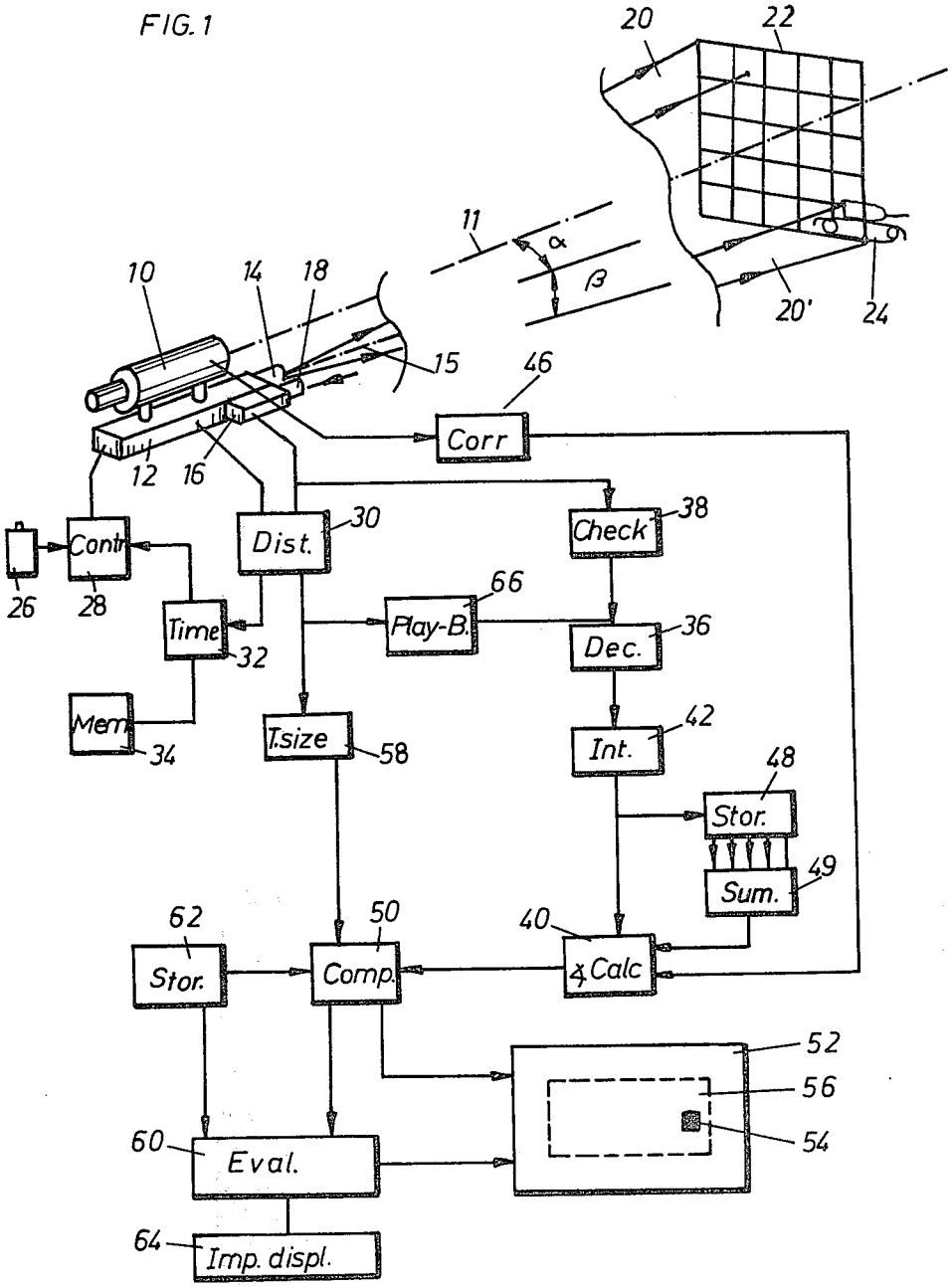
FIG. 1 shows a simplified diagrammatic view of the shot simulator along with a block diagramm of the analysing and evaluating means according to one preferred embodiment of the invention.

FIG. 1 shows schematically a sight 10 which typically will be the sight of a training weapon and which may be a gyro-stabilized sight and which may be kept directed towards a target independently of movements of the weapon. Coupled to the sight 10 as a laser transmitter having an optical system 14 for aligning the emitted light. Further coupled to the sight 10 is a laser light receiver 16 having a focusing optical system 18. The optical axis 15 of the optical system 14 is adjusted parallel to the line of sight 11 of the sight 10, and so is the optical axis of the focusing optics 18. The laser transmitter 12 is adapted to emit single pulses of laser light beams 20 which have a very small angular divergence owing to the parallelizing effect of the optical system 14. The laser light beams 20 are, however, emitted under different angular deviations from the optical axis 15 or the line of sight 11 in such a manner that all the beams together or in succession will illuminate a field 22 of defined size in the target area. In the shown embodiment the various pulse shaped laser light beams 20, 20' are emitted from the laser transmitter 12 in such angular relations to each other that the solid angle segments illuminated by the single beams are contiguous and will together form a matrix arrangement filling the total solid angle of the composite field 22. Each single field of the matrix may be characterized by an identification associated with the corresponding laser beam, which identification may consist in a characteristic puls code of the laser light signal or by the time sequence with which the laser light beams illuminating the individual fields of the matrix are emitted. A target object 24 located in a position within the composite field 22, which target object preferably is equipped with one or more retro-reflectors (prism reflectors or triple mirror reflectors) will reflect the light of one or more of the beams 20, 20' back into the receiver 16. From the identification of the received laser light it is possible to determine the individual field 20' of the matrix 22 in which the target 24 is positioned. Since the composite matrix field 22 is positioned centrically to the line of sight 11 it is possible to calculate from the identified field 20' the horizontal and vertical angular deviations $\alpha$ and $\beta$ of the hit target 24 from the line of sight 11.

The structure of the laser transmitter 12 and the receiver 16 is not shown and described here in detail as they are well known to the man skilled in the art. Examples for a laser transmitter and receiver which are particularly adapted for being used in the present invention are disclosed in pending United States patent applications Ser. Nos. 917,084 filed June 19, 1978 and entitled "laser light transmitter, especially for purposes of shot simulation" and 5029 filed Jan. 19, 1979 and entitled "apparatus for determining off-aim during firing simulation". Reference is made to these applications for more detailed disclosure of the apparatus. According to one of these embodiments the laser transmitter 12 may comprise a plurality of individually controllable laser diodes having their light emitting faces connected to optical conductors the ends of which are arranged in the focusing plane of the optical system 14 to form a contiguous matrix arrangement. With this arrangement the laser light produced by any of the laser diodes will be projected by the optical system 14 into one of the fields of the matrix 22 in the target area. The individual laser diodes are driven with a different pulse code and/or in a predetermined time sequence, and by comparing the pulse code and/or the time relation of the laser light received by the receiver 16 with the emitted laser light the corresponding field 20' of the matrix 22 can be determined.

According to another embodiment disclosed in the above mentioned applications the laser transmitter 12 comprises a number of semiconductor laser diodes with optical conductors connected thereto, which number is smaller than the number of fields of the matrix 22, and the end of the optical conductors are arranged in the focusing plane of the optical system 14 in such a manner that each laser diodes illuminate a whole horizontal stripe of the composite matrix field 22 in the target area. The receiver 16 comprises a corresponding number of individual sensors, for example photo diodes or avalanche diodes, which are arranged in the image plane of the optical system 18 so that each sensor receives light from one of the vertical stripes of the matrix field 22. With this arrangement each laser diode of the transmitter 12 is associated with a particular horizontal stripe and each receiving diodes of the receiver 16 is associated with the particular vertical stripe of the matrix. By determining the identifying pulse code of the received light and by identifying the sensor receiving the light it is possible to identify the particular field 20' of the matrix 22 in which the reflecting target 24 is positioned.

This particular structure of the laser transmitter and receiver does not form part of the present invention, and the invention is not restricted to the particular embodiments disclosed in the aforementioned prior patent applications.

According to the present invention the structure and mode of operation of the shot simulator are adapted for the simulation of guided missiles which are controlled towards the target by the sight, comprising particularly the so-called beam rider missiles and similar systems which are particular useful as anti-tank missiles or anti-aircraft missiles. As is wellknown to the man skilled in the art the remote control of these missiles is coupled with the sight in such a way that the missile is controlled so as to follow the momentary position of the line of sight or tracking point of the sight 10. When firing the missile it is therefore necessary to keep the tracking point of the sight coincident with the target during the whole travelling time of the missile. Deviations of the tracking point from the target which may be caused by movements of the weapon and/or movements of the target or by faulty operation should be as few and as short as possible and they should not occur during the important final phase of the travelling time of the missile. The simulation, training and evaluation of the shooting with this type of missiles is the purpose of the shot simulator according to the invention.

A trigger 26 serves for triggering the simulated shot. Upon operating the trigger 26 a control unit 28 controls the laser transmitter 12 to emit a cycle of laser light signals which will simultaneously or successively illuminate all fields of the composite matrix 22, and this cycle will be continuously repeated during an elongated measurement period of time. The length of this measurement period corresponds to the time of flight of the simulated missile to the target 24. The laser transmitter 12 and receiver 16 are therefore coupled to a distance meter 30 which calculates the true distance to the target 24 from the travelling time between emission and reception of a laser light pulse. This distance value is fed into a time of flight calculator 32 which will calculate the time of flight using the measured distance and stored data describing the velocity profile of the simulated missile type. The calculated time of flight is supplied to the control unit 28 which will inactivate the laser transmitter 12 at the end of the calculated time.

During the whole measurement period the aimsman will try to direct the line of sight 11 to the target 24 as precisely as possible. In actual practice, however, deviations of smaller or greater magnitude and duration will be unavoidable, so that the target 24 will temporally be positioned also in the outer fields of the composite matrix field 22 and will therefore have angular deviations $\alpha$, $\beta$ in azimuth and elevation with respect to the line of sight 11. A pulse decoder 36 is connected to the receiver 16 for determining from the pulse code of the received laser light signal the corresponding segment of field 20' of the composite matrix 22. Ahead of the pulse decoder 36 there may be connected a pulse checking unit 38 which will determine under probability criteria whether the received impulse is a useful signal for evaluation or a spurious signal such as a noise pulse, an interference pulse or an undesired reflection from an object other than the target 24.

The decoder 36 identifying the particular matrix field 20' will supply a corresponding signal to the angle calculator 40 which will calculate therefrom the angular deviations $\alpha$ and $\beta$ in azimuth and elevation between the target 24 and the line of sight 11. This calculation of the deviation angles $\alpha$ and $\beta$ will obviously have only a limited accuracy depending on the number of horizontal and vertical stripes of the composite matrix 22, which numbers depends on the number of the laser diodes and/or sensor diodes used in the transmitter 12 and the receiver 16, respectively. In order to limit the apparatus costs this number is limited so that the composite matrix 22 for example will only have five horizontal and five vertical stripes which make a total of twentyfive individually identifiable solid angle segments 20, 20'.

It is possible to increase the accuracy of the calculation of the angular deviations $\alpha$ and $\beta$ by using an interpolator 42 connected between the decoder 36 and the angle calculator 40. This interpolation makes use of the fact that the solid angle sectors 20, 20' illuminated by the individual laser diodes of the transmitter 12 and/or received from the individual sensors of the receiver 16 will have a certain overlap, which may be produced by off-setting the ends of the optical conductors from the exact focusing planes of the optical systems 14 and 18. Depending on whether the target 24 is fully within a particular angular segment 20' or on the boundary between adjacent angular segments or even within two or more such segments the decoder 36 will receive signals which correspond to one or two or more of the angular segments 20, 20' of the matrix 22. By an averaging operation over these various signals the angular deviations $\alpha$ and $\beta$ between the target 24 and the line of sight can be calculated with greater accuracy than that allowed by the number of solid angle segments 20, 20'. For example the interpolation unit may produce a position signal L, representing the horizontal deviation (X-co-ordinate) of the line of sight from the target object 24 and which is formed according to the formula $$L=(5\,L_1+4\,L_2+3\,L_3+2\,L_4+L_5):(L_1+L_2+L_3+L_4+L_5)$$

wherein $L_1$, $L_2$ etc. are the signals supplied from the decoder 36 associated with the individual laser diodes of the transmitter 12. If for example the receiver 16 receives reflected signals from those angular segments illuminated by the laser diodes $L_3$ and $L_4$ of the laser transmitter the signals will be $L_3=L_4=1$ and $L_1=L_2=L_5=0$, and therefore the position signal L will have the values $(3+2):(1+1)=5/2$.

Using a similar formula a position signal may also be formed for the vertical deviation between the target and the line of sight. These position signals may be multiplied be suitable normalizing factors.

From these position signals, the angle calculator 40 will calculate the deviation angles $\alpha$ and $\beta$. The calculator 40 may also apply position corrections which for example may result from movements of the weapon relative to the gyro stabilized sight 10. For this purpose a correction signal supply unit 46 is provided controlled directly from the stabilizing means of the sight 10.

For taking into account the inertia of the simulated missile when responding to control signals, i.e. to position variations of the sight tracking point, it is desirable to supply to the angle calculator 40 not just the momentary value of the position signal determined by the decoder 36 or the interpolator 42 but rather a time average value which is continuously obtained by averaging the signal over a fraction of the total measurement period. For this purpose the momentary position signal L from the interpolator 42 is supplied to a storage means 48 which will for example store a total number of n successively measured values of the position signal L. With each input of a fresh signal value the stored value preceding this by n measurements will be cancelled from the storage means 48. The storage means 47 will therefore always contain the "newest" n measurement values, and from these values a summing means 49 will form an average value which is supplied to the angle calculator 40. The angular deviation calculated by the angle calculator 40 will therefore correspond to a continuously varying time average over the n latest measurements, for example an average over a time interval of 0.5 seconds within the total measurement periods which corresponds to the time of flight of the missile and may be as long as 15 to 20 seconds. The numer n of measurements used for averaging, i.e. the length of the averaging time interval, may be selected and varied according to the particular missile type to be simulated.

The angular deviation values $\alpha$ and $\beta$ calculated by the calculator 40 are supplied into a comparator 50. The comparator 50 also receives the output signal of a target size calculator 58 which from the target distance determined by the distance meter 30 will calculate the apparent size of a target object having typical dimensions, i.e. the viewing angle with which in the measured distance a target object having a size of, say 2 meters will appear. The comparator 50 will compare this apparent target size with the angular deviation determined by the angle calculator 40. This takes account of the fact that any particular angular deviation between the line of sight and the target will still give the a hit if the target is close and appears large, while resulting in a miss if the target is remote and appears small. Thus the shot evaluation depends substantially on a correlation between the angular deviation of the tracking point and the apparent size of the target.

The relative position between the tracking point and the target determined by the comparator 50 may be displayed by means of a display unit 52. This may comprise for example a cathode-ray tube screen or a matrix array of light emitting diodes and will be controlled in such a way that an index or mark 54 formed by a light dot or a cross indicates the momentary position of the tracking point, i.e. the line of sight 11 in its relative position to the target corresponding to the angular deviations $\alpha$ and $\beta$, whereas another mark 56, for example illustrated lines forming a rectangular frame, represents the target in its apparent size as calculated by the target size calculator 52, this target representation being always centred with respect to the display screen 52. This enables the aimsman or preferably the supervisor to judge during the whole time of flight of the simulated shot the accuracy with which the sight tracking point represented by the mark 54 is kept on or close to the target representation 56 representing the apparent target size.

With the result of the position comparison of the tracking point and the target obtained in the comparator 50 an evaluator 60 is supplied which is connected to a storage means 62 wherein the evaluation criteria are stored. These comprise mainly the maximum deviation limits which are admissible for the particular missile type, further data giving information when a downward deviation of the tracking point must be considered equivalent to ground contact of the missile and therefore to a missfire, as well as additional data which may be considered, for example data representing the vulnerability of the target object for the particular missile type. Using these data and the calculated deviations the evaluator 60 decides whether the simulated shot would have resulted in a hit and a distruction of the target, and accordingly controls the display 52 so that a hit, a misfire, a ground contact or similar events may be indicated by particular symbols or by written information. Additionally the evaluator 60 may control an impact display apparatus 64 which may be positioned at the target site for generating smoke, a light flash or similar effects which would be caused by a real missile impact.

The versatility of the shot simulator may be further improved by a playback memory 66 in which the signals supplied by the distance meter 30, the pulse checking unit 38 and the angle calculator 40 may be stored so that they can be read again at any desired time in order to repeat the shot evaluation and display without actually operating the laser transmitter 12. Additionally in the playback memory 66 data may be stored representing a "test shot" and which may be read out in order to check the proper functioning of the whole apparatus.

The various calculating checking, evaluating and storing units represented as separate units in the forgoing description of the embodiment could of course be combined to form parts or subunits of one signal memory and calculator.

Figure 2:
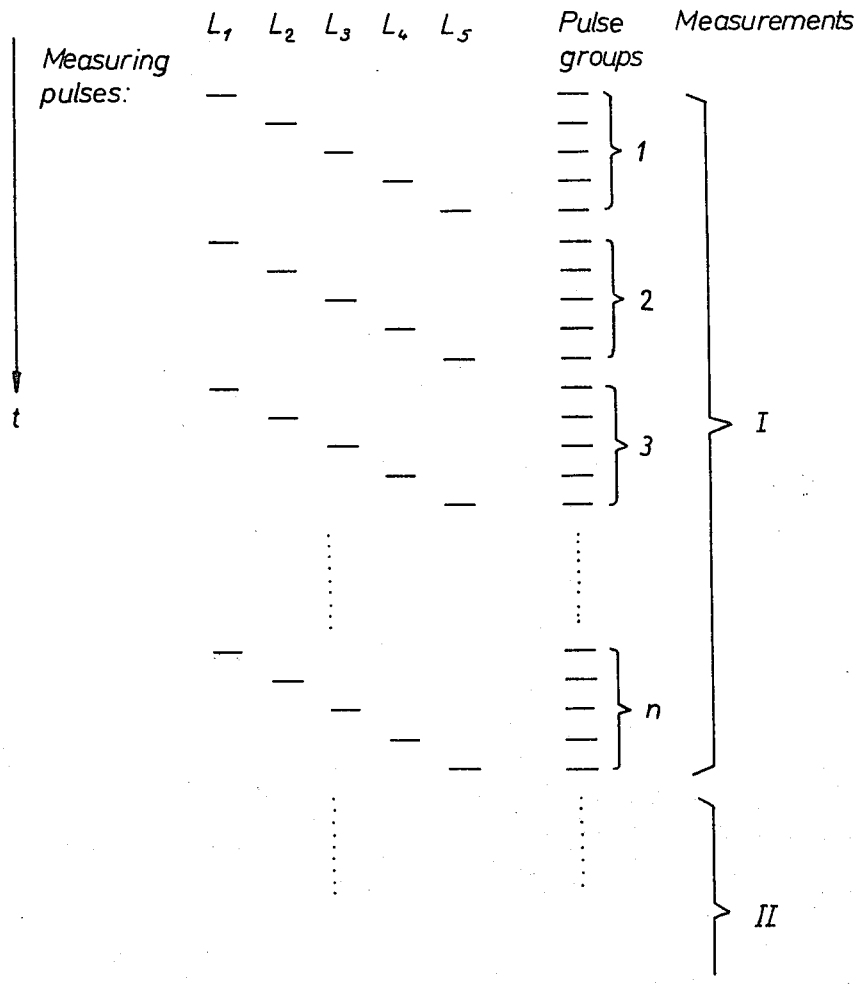
FIG. 2 shows a diagramm representing the time sequence of the laser signals used in the device according to FIG. 1.

FIG. 2 shows a scheme for one possible time sequence for the driving of the individual laser diodes $L_1$, $L_2$ etc. of the laser transmitter 12. Each of the laser diodes is associated with one solid angle segment of the matrix 22, as mentioned above. The laser diodes $L_1$, $L_2$ etc. are so driven that they will successively emit short laser pulses represented as short horizontal lines in FIG. 2 where the vertical coordinate downwardly represents the time. The frequency of all the laser pulses may be 60 cycles so that with a total number of, say, five laser diodes each individual laser diode will be driven at a frequency of 12 cycles. In the case of five laser diodes any five successive pulses of all the diodes will form one pulse group as represented in the right part of FIG. 2 under the heading pulse group as pulse group number 1, 2 . . . n etc. Each pulse group will scan the whole composite matrix field 22 in the case where the laser diodes will illuminate the horizontal stripes of the matrix whereas the vertical stripes of the matrix are associated to corresponding sensors of the receiver 16, as described above. Alternatively, a total number of 25 laser diodes may be used, in which case 25 pulses would form one pulse group. Only one sensor in the received 16 would be required in this case. For the evaluation a particular number m of pulse groups will be combined for averaging the measured values thereby obtaining one "measurement" (measurement I, II etc. in FIG. 2). By this averaging over a number of pulse groups the influence of spurious pulses is avoided and the inertia of the simulated missile may be simulated. Each measurement I, II represents a particular fraction of the total measurement period, which corresponds to the time of flight of the simulated missile.

I claim:

1. A shot simulator using laser light for simulating the shooting of sight guided missiles, comprising a sight for tracking a target, a laser transmitter coupled to the sight for emitting laser light beams having different angular deviations from the line of sight and being characterized by different pulse codes, a receiver for receiving laser light reflected from said target, a decoder coupled to said receiver for decoding said pulse code of the reflected light and providing an output indicative of the momentary angular deviation of the target from said line of sight, comparing means for comparing said momentary angular target deviation with stored maximum admissible deviation limits, means coupled to the trigger of the simulated weapon for continuously repeating said emission of the laser light, said decoding of the reflected light and said comparison of the angular target deviation over a measurement period corresponding to the time of flight of the simulated missile, hit indicating means, and control means for said hit indicating means coupled to said comparing means and being responsive to the result of said comparison obtained during at least part of said measurement period, so as to produce a hit indication only if said angular deviations have been within said stored limits during a sufficient portion of the total measurement period.

2. A shot simulator according to claim 1, further comprising a distance meter coupled to said receiver for calculating the target distance from the travelling time of said laser light, and a time of flight calculator coupled to said distance meter for calculating the time of flight of the simulated missile from the measured distance and from stored velocity data, said measurement period being controlled responsive to the output of said time of flight calculator.

3. A shot simulator according to claim 2, further comprising an apparent target size calculator coupled to said distance meter for calculating from the target distance the distance-dependent apparent target size, and second comparing means for comparing the apparent target size with the momentary angular deviations of the target from said line of sight, said control means for said hit indicating means being responsive to the result of said comparing means.

4. A shot simulator according to one of claims 1, 2, or 3, further comprising time averaging means for continuously producing a time average of the angular target deviation from said line of sight over an averaging time corresponding to a fraction of the total measurement period, said control means being responsive to the result of said averaging means.

5. A shot simulator as claimed in one of claims 1, 2, or 3, wherein said laser emitter is adapted for emitting differently coded laser light signals into a plurality of discrete, contiguous solid angle segments grouped around the line of sight, and comprising interpolation means coupled to said decoder for interpolating between reflected laser light signals received from different adjacent solid angle sectors.

6. A shot simulator as claimed in one of claim 3, wherein said hit indicating means comprises a display for displaying the momentary apparent target size and the momentary tracking point of the line of sight during substantially the whole measurement period.

7. A shot simulator as claimed in one of claim 1, wherein said control means for said hit indicating means comprises means for differently weighting downward, upward or laterally directed target deviations.

* * * * *